US011664627B2

(12) United States Patent
Kodama

(10) Patent No.: US 11,664,627 B2
(45) **Date of Patent: *May 30, 2023**

(54) SHIELDED BOARD-TO-BOARD CONNECTOR

(71) Applicant: Huawei Technologies Co., Ltd., Shenzhen (CN)

(72) Inventor: Hiromitsu Kodama, Yokohama (JP)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/805,065

(22) Filed: Jun. 2, 2022

(65) Prior Publication Data

US 2022/0368081 A1 Nov. 17, 2022

Related U.S. Application Data

(63) Continuation of application No. 17/229,326, filed on Apr. 13, 2021, now Pat. No. 11,367,980, which is a continuation of application No. 16/737,621, filed on Jan. 8, 2020, now Pat. No. 11,031,737, which is a continuation of application No. 16/334,170, filed as (Continued)

(51) Int. Cl.

| | |
|---|---|
| ***H01R 13/62*** | (2006.01) |
| ***H01R 13/6582*** | (2011.01) |
| ***H01R 12/71*** | (2011.01) |
| *H01R 13/6594* | (2011.01) |

(Continued)

(52) U.S. Cl.

CPC ..... *H01R 13/6582* (2013.01); *H01R 12/716* (2013.01); *H01R 12/707* (2013.01); *H01R 12/73* (2013.01); *H01R 13/6594* (2013.01)

(58) Field of Classification Search

CPC ..... H01R 23/668; H01R 23/684

See application file for complete search history.

(56) References Cited

U.S. PATENT DOCUMENTS 3,836,703 A * 9/1974 Coules ..... H05K 7/142 24/336

5,545,051 A 8/1996 Summers et al.

(Continued)

FOREIGN PATENT DOCUMENTS

CN 1163496 A 10/1997

CN 2736999 Y 10/2005

(Continued)

*Primary Examiner* — Phuong Chi Thi Nguyen

(74) *Attorney, Agent, or Firm* — Slater Matsil, LLP

(57) ABSTRACT

A board-to-board connector for connecting printed boards to each other includes a receptacle comprising a plurality of signal contact elements to be electrically connected to one of the printed boards, and a plug comprising a plurality of signal contact elements to be electrically connected to the other of the printed boards, wherein each of the signal contact elements of the plug is in contact with the corresponding signal contact element of the receptacle when the plug has been inserted into the receptacle. The receptacle comprises an electromagnetic interference shield which continuously or discontinuously surrounds the plurality of signal contact elements of the receptacle, and the plug comprises an electromagnetic interference shield which continuously or discontinuously surrounds the plurality of signal contact elements of the plug.

20 Claims, 11 Drawing Sheets

Related U.S. Application Data application No. PCT/CN2016/099350 on Sep. 19, 2016, now Pat. No. 10,566,742.

(51) Int. Cl.
*H01R 12/73* (2011.01)
*H01R 12/70* (2011.01)

(56) References Cited

U.S. PATENT DOCUMENTS

| | | | | |
|---|---|---|---|---|
| 5,556,286 | A | 9/1996 | Ikesugi et al. | |
| 5,563,770 | A * | 10/1996 | Bethurum | G06K 19/07743 257/679 |
| 5,876,217 | A | 3/1999 | Ito et al. | |
| 5,921,814 | A | 7/1999 | Maruyama | |
| 6,095,830 | A | 8/2000 | Hirata et al. | |
| 6,402,566 | B1 | 6/2002 | Middlehurst et al. | |
| 6,575,761 | B1 * | 6/2003 | Regnier | H01R 9/0515 439/63 |
| 7,070,423 | B2 | 7/2006 | Zhang et al. | |
| 7,090,508 | B1 | 8/2006 | Chen | |
| 7,510,445 | B2 | 3/2009 | Tokunaga | |
| 8,092,232 | B2 | 1/2012 | Takeuchi | |
| 8,113,884 | B2 | 2/2012 | Matsuzaki et al. | |
| 8,888,506 | B2 | 11/2014 | Nishimura et al. | |
| 9,088,113 | B2 | 7/2015 | Funayama et al. | |
| 10,566,742 | B2 | 2/2020 | Kodama | |
| 2005/0095913 | A1 | 5/2005 | Fan | |
| 2006/0063432 | A1 | 3/2006 | Chen | |
| 2008/0064229 | A1 | 3/2008 | Tokunaga | |
| 2008/0139057 | A1 | 6/2008 | Fukuchi | |
| 2014/0120760 | A1 * | 5/2014 | Zieman | H01R 12/91 29/874 |

FOREIGN PATENT DOCUMENTS

| | | | |
|---|---|---|---|
| CN | 101335406 | A | 12/2008 |
| CN | 201490385 | U | 5/2010 |
| CN | 101740952 | B | 3/2013 |
| CN | 108321573 | A | 7/2018 |
| EP | 1628369 | A1 | 2/2006 |
| EP | 2712030 | A1 | 3/2014 |
| JP | H09237655 | A | 9/1997 |
| JP | 2000133342 | A | 5/2000 |
| JP | 2006012625 | A | 1/2006 |
| JP | 2006059589 | A | 3/2006 |
| JP | 2006156023 | A | 6/2006 |
| JP | 2008146870 | A | 6/2008 |
| JP | 2008243703 | A | 10/2008 |
| JP | 2010080691 | A | 4/2010 |
| JP | 2010097759 | A | 4/2010 |
| JP | 2011228082 | A | 11/2011 |
| JP | 2012054173 | A | 3/2012 |
| JP | 2013041771 | A | 2/2013 |
| JP | 2013140755 | A | 7/2013 |
| JP | 2014063589 | A | 4/2014 |
| JP | 2016066477 | A | 4/2016 |
| JP | 2016157529 | A | 9/2016 |

* cited by examiner

SHIELDED BOARD-TO-BOARD CONNECTOR

CROSS-REFERENCE TO RELATED APPLICATIONS

This application is a continuation of U.S. patent application Ser. No. 17/229,326, filed on Apr. 13, 2021, which is a continuation of U.S. patent application Ser. No. 16/737,621, filed on Jan. 8, 2020, now U.S. Pat. No. 11,031,737, which is a continuation of U.S. patent application Ser. No. 16/334,170, filed on Mar. 18, 2019, now U.S. Pat. No. 10,566,742, which is a national stage of International Application No. PCT/CN2016/099350, filed on Sep. 19, 2016. All of the aforementioned applications are hereby incorporated by reference in their entireties.

TECHNICAL FIELD

The present invention relates to a connector, and more particularly, a board-to-board connector for connecting printed boards to each other.

BACKGROUND

It is desirable to make a board-to-board connector adaptable to high speed signal transmission, where the board-to-board connector is mounted in the smartphone and is for connecting a mother board and another board in the smartphone.

High speed signal transmission in a connector tends to increase EMI (electromagnetic interference) noise emitted from a connection section between signal contact elements of the connector. The board-to-board connector adaptable to high speed signal transmission needs to be capable of shielding the EMI noise.

Conventional board-to-board connectors for smartphones, which have a lower height, e.g. about 0.6 to 0.7 mm, are not provided with an electromagnetic interference shield. On the other hand, conventional board-to-board connectors for computers or televisions are provided with an electromagnetic interference shield. However, since these board-to-board connectors with an electromagnetic interference shield have a height considerably larger than that of the board-to-board connectors for smartphones, it may be impossible to apply the structure of conventional board-to-board connectors with an electromagnetic interference shield to the board-to-board connectors for smartphones.

In addition, conventional board-to-board connectors with an electromagnetic interference shield have a structure in which only either one of a plug and a receptacle comprises the shield which is configured to surround both a plug housing and a receptacle housing when the plug has been inserted into the receptacle. These conventional board-to-board connectors cannot completely shield EMI noise. For example, in conventional board-to-board connectors with an electromagnetic interference shield, EMI noise may leak out by passing through a gap between the exterior of the plug housing and the interior of the receptacle housing and through the plug housing and the receptacle housing made of resin.

Japanese Unexamined Patent Application, First Publication No. 2012-54173 discloses a board-to-board connector comprising a plug and a receptacle which is fittable to the plug, wherein the plug comprises an insulation plug housing and a plurality of plug shield members which are fixed to the plug housing, and the receptacle comprises an insulation receptacle housing and a plurality of receptacle shield members which are fixed to the receptacle housing, and wherein ground contact portions extending from the plug shield members are respectively in direct contact with ground contact portions extending from the plug shield members. However, the plug shield members as well as the receptacle shield members are aligned in the longitudinal direction of the connector, but they are not provided on the opposite ends in the longitudinal direction of the connector, that is, the short side section of the periphery of the connector. Therefore, EMI noise may leak out by passing through the opposite end portions of the plug housing and the receptacle housing, which are positioned at the opposite ends. Furthermore, since there is a gap between the plug shield members and the receptacle shield members, EMI noise may leak out by passing through the gap.

Japanese Unexamined Patent Application, First Publication No. 2010-97759 discloses a board-to-board connector comprising a receptacle and a plug, wherein the receptacle comprises an insulation stationary housing, a movable housing which is provided on the stationary housing, a first shield cover surrounding the exterior of the stationary housing, and a second shield cover surrounding the exterior of the movable housing, and the plug comprises an insulation plug housing configured to be insertable into the movable housing and a plug shield cover surrounding the exterior of the plug housing. The second shield cover is provided with a plurality of bending tabs which are in direct contact with the plug shield cover when the plug has been fitted to the receptacle. However, the bending tabs are provided on the short side section of the periphery of the connector, but they are not provided on the long side section of the periphery of the connector. Therefore, EMI noise may leak out by passing through a gap between the long side section of the plug shield cover and the long side section of the movable housing and through the long side section of the movable housing.

Japanese Unexamined Patent Application, First Publication No. 2008-243703 discloses a board-to-board connector comprising a receptacle and a plug, wherein the receptacle comprises an insulation receptacle housing and a receptacle shield member surrounding an exterior of the receptacle housing, and the plug comprises an insulation plug housing and plug shield members covering the opposite ends of the plug housing. The receptacle shield member is provided with a plurality of bending tabs which are in direct contact with the plug shield members when the plug has been fitted to the receptacle. However, the bending tabs are provided on the short side section of the periphery of the connector, but they are not provided on the long side section of the periphery of the connector. Therefore, EMI noise may leak out by passing through a gap between the long side section of the plug housing and the long side section of the receptacle housing and through the long side section of the plug housing and the long side section of the receptacle housing.

There exists a need to address the aforementioned unresolved problems of conventional board-to-board connectors, in particular, to improve the EMI noise shielding performance of board-to-board connectors.

SUMMARY

An object of the present invention is to provide a board-to-board connector capable of eliminating or reducing a leakage of EMI noise generated by the signal contact elements of the receptacle and the plug.

This object is achieved by means of a board-to-board connector for connecting printed boards to each other, the connector comprising: a receptacle comprising a plurality of signal contact elements to be electrically connected to one of the printed boards, and a plug comprising a plurality of signal contact elements to be electrically connected to the other of the printed boards, the signal contact elements being configured so that each of the signal contact elements of the plug is in contact with the corresponding signal contact element of the receptacle when the plug has been inserted into the receptacle, wherein the receptacle comprises an electromagnetic interference shield which continuously or discontinuously surrounds the plurality of signal contact elements of the receptacle, and the plug comprises an electromagnetic interference shield which continuously or discontinuously surrounds the plurality of signal contact elements of the plug, and wherein the shield of the receptacle and the shield of the plug are configured to be in direct contact with each other when the plug has been inserted into the receptacle, the contact arrangement being provided in the entire perimeter of the connector.

By means of this board-to-board connector, when the plug is inserted into the receptacle and each of the signal contact elements of the plug is in contact with the corresponding signal contact element of the receptacle, EMI noise generated by the signal contact elements of the receptacle and the plug is shielded by the shields of the receptacle and the plug in the entire perimeter of the connector.

In one embodiment of the board-to-board connector, the receptacle comprises an electrical insulation receptacle housing in which the plurality of signal contact elements of the receptacle are installed, the receptacle housing including a peripheral portion surrounding the plurality of signal contact elements of the receptacle. The shield of the receptacle covers the interior of the peripheral portion of the receptacle housing. In addition, the plug comprises an electrical insulation plug housing in which the plurality of signal contact elements of the plug are installed, the plug housing including a peripheral portion surrounding the plurality of signal contact elements of the plug, the peripheral portion of the plug housing being configured to be insertable into the peripheral portion of the receptacle housing. The shield of the plug covers the exterior of the peripheral portion of the plug housing.

In a preferred embodiment of the board-to-board connector, the shield of the plug is provided with a plurality of abutment portions for bringing the shield of the plug into direct contact with the shield of the receptacle. The abutment portions are positioned at intervals around the entire shield of the plug. In this embodiment, the abutment portions may be formed like a leaf spring. The abutment portions formed like a leaf spring outwardly project from a surface of the shield of the plug in an oblique direction, and the abutment portions are configured to be elastically deformed by abutment with the shield of the receptacle when the plug has been inserted into the receptacle.

In another preferred embodiment of the board-to-board connector, the shield of the receptacle is provided with a plurality of abutment portions for bringing the shield of the receptacle into direct contact with the shield of the plug. The abutment portions are positioned at intervals around the entire shield of the receptacle. In this embodiment, the abutment portions are formed like a leaf spring. The abutment portions formed like a leaf spring inwardly project from a surface of the shield of the receptacle in an oblique direction, and the abutment portions are configured to be elastically deformed by abutment with the shield of the plug when the plug has been inserted into the receptacle.

In a further preferred embodiment of the board-to-board connector, the shield of the plug is provided with a plurality of first abutment portions for bringing the shield of the plug into direct contact with the shield of the receptacle, and the shield of the receptacle is provided with a plurality of second abutment portions for bringing the shield of the receptacle into direct contact with the shield of the plug. The first abutment portions are positioned at intervals around the entire shield of the plug, and the second abutment portions are positioned at intervals around the entire shield of the receptacle. In this embodiment, the first abutment portions are formed like a leaf spring. The first abutment portions formed like a leaf spring outwardly project from a surface of the shield of the plug in an oblique direction, and the first abutment portions are configured to be elastically deformed by abutment with the shield of the receptacle when the plug has been inserted into the receptacle. In addition, the second abutment portions are formed like a leaf spring. The second abutment portions like a leaf spring inwardly project from a surface of the shield of the receptacle in an oblique direction, and the second abutment portions are configured to be elastically deformed by abutment with the shield of the plug when the plug has been inserted into the receptacle. Preferably, the first and second abutment portions may be positioned so that the first abutment portions are arranged alternately with the second abutment portions when the plug has been inserted into the receptacle.

In the above-mentioned embodiments of the board-to-board connector, the shield of the receptacle may comprise a grounding portion to be electrically connected to one of the printed boards. In addition, the shield of the plug may comprise a grounding portion to be electrically connected to the other of the printed boards.

Furthermore, in the above-mentioned embodiments of the board-to-board connector, each signal contact element of the receptacle includes a soldering section to be soldered on one of the printed boards, and a bottom portion of the receptacle housing may be provided with at least one opening through which soldering sections of a plurality of signal contact elements of the receptacle are visible from the insertion port side of the receptacle.

In a preferred embodiment of the board-to-board connector, the connector is adapted to be mounted in a smartphone. Nevertheless, the board-to-board connector according to the present application may be mounted in other kinds of electronic devices, such as mobile phones, tablet-type computers, notebook-type computers, desk calculators, electronic notebooks, portable televisions, digital cameras, medical apparatuses, or the like.

The term "printed board" should be understood to mean various electronic boards including, for example, PCBs (printed circuit boards), PWBs (printed wiring boards), FPCs (flexible printed circuits), or the like.

BRIEF DESCRIPTION OF THE DRAWINGS

The invention can be better understood from the following detailed description of non-limiting embodiments thereof, and on examining the accompanying drawings, in which.

DETAILED DESCRIPTION OF ILLUSTRATIVE EMBODIMENTS

First Embodiment

The board-to-board connector 1 shown in FIGS. 1 to 4 is for connecting two boards (a first board 2 and a second board 3) together, and in particular, enables signal transmission between the first and second boards 2 and 3. The board-to-board connector 1 is suitable for a smartphone and is adapted to be mounted in a smartphone. Both first and second boards 2 and 3 to be connected to each other by the board-to-board connector 1 are pails which may be mounted in the smartphone.

Figure 1:
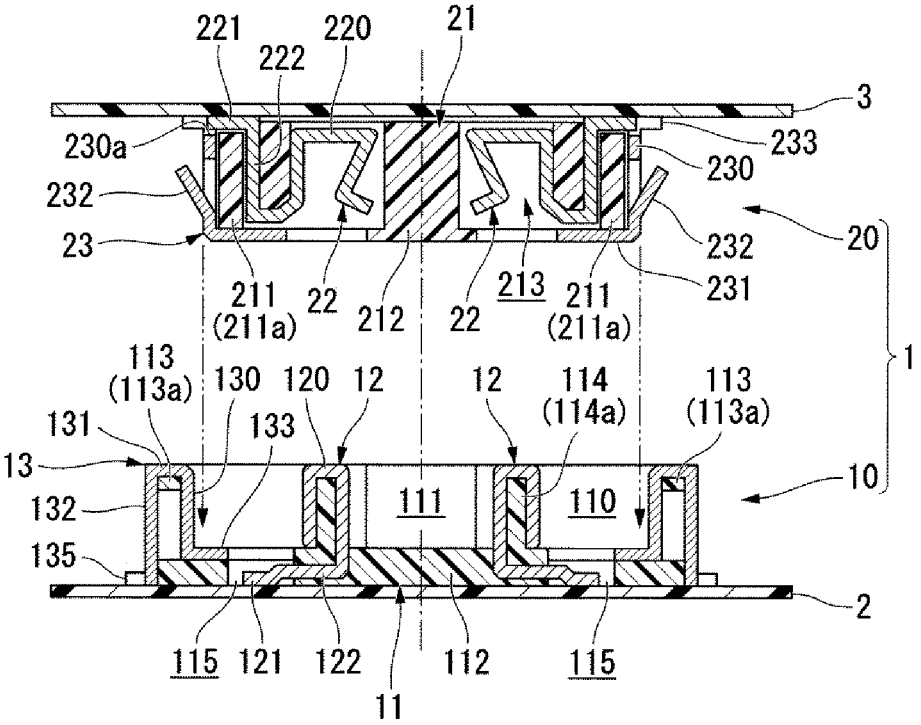
FIG. 1 shows one cross-sectional schematic diagram of a board-to-board connector according to a first embodiment of the present application, and this is a cross-sectional view along line A-A shown in FIGS. 3 and 4.
Figure 2:
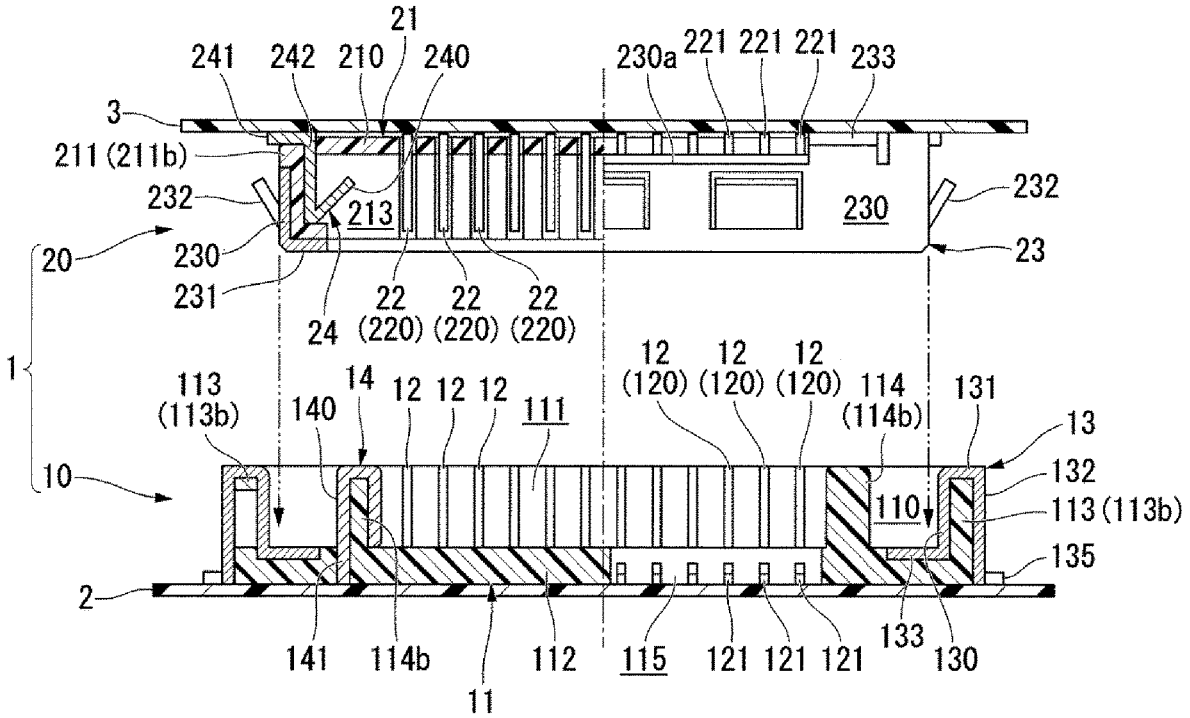
FIG. 2 shows another cross-sectional schematic diagram of the board-to-board connector according to the first embodiment of the present application, and this is a cross-sectional view along line B-B shown in FIGS. 3 and 4.

As shown in FIGS. 1 and 2, the board-to-board connector 1 comprises a receptacle 10 and a plug 20 which are fittable to each other. The receptacle 10 is mounted on the first board 2, such as a mother board of the smartphone, and the plug 20 is mounted on the second board 3, such as the other board to be connected to the mother board. Alternatively, the second board 3 on which the plug 20 is mounted may be the mother board, and the first board 2 on which the receptacle 10 is mounted may be the other board to be connected to the mother board.

Figure 3:
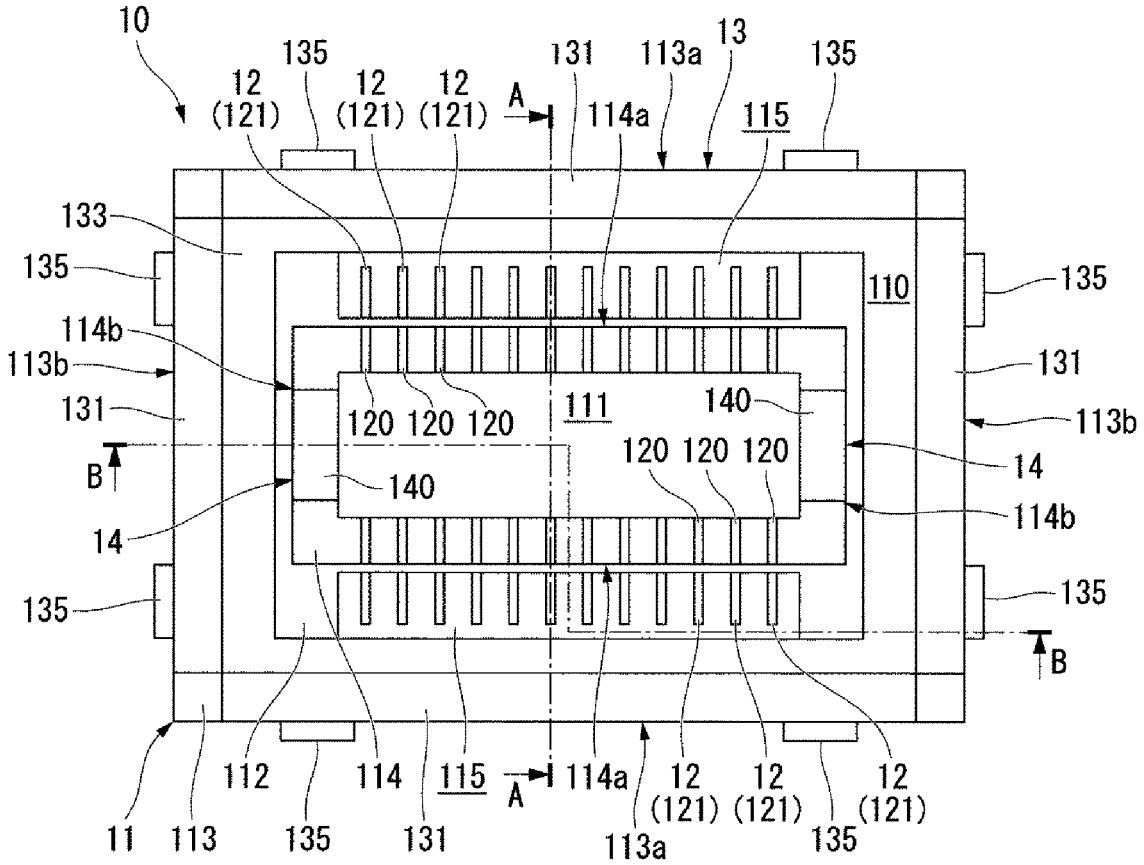
FIG. 3 shows a planar schematic diagram of a receptacle in the board-to-board connector according to the first embodiment of the present application.

Referring to FIGS. 1 to 3, the receptacle 10 is a female connector part configured to be able to receive the plug 20, and has the appearance of a substantially rectangular parallelepiped as a whole. The receptacle 10 comprises an electrical insulation receptacle housing 11, a plurality of signal contact elements 12, an electromagnetic interference shield 13, and power contact elements 14.

Figure 4:
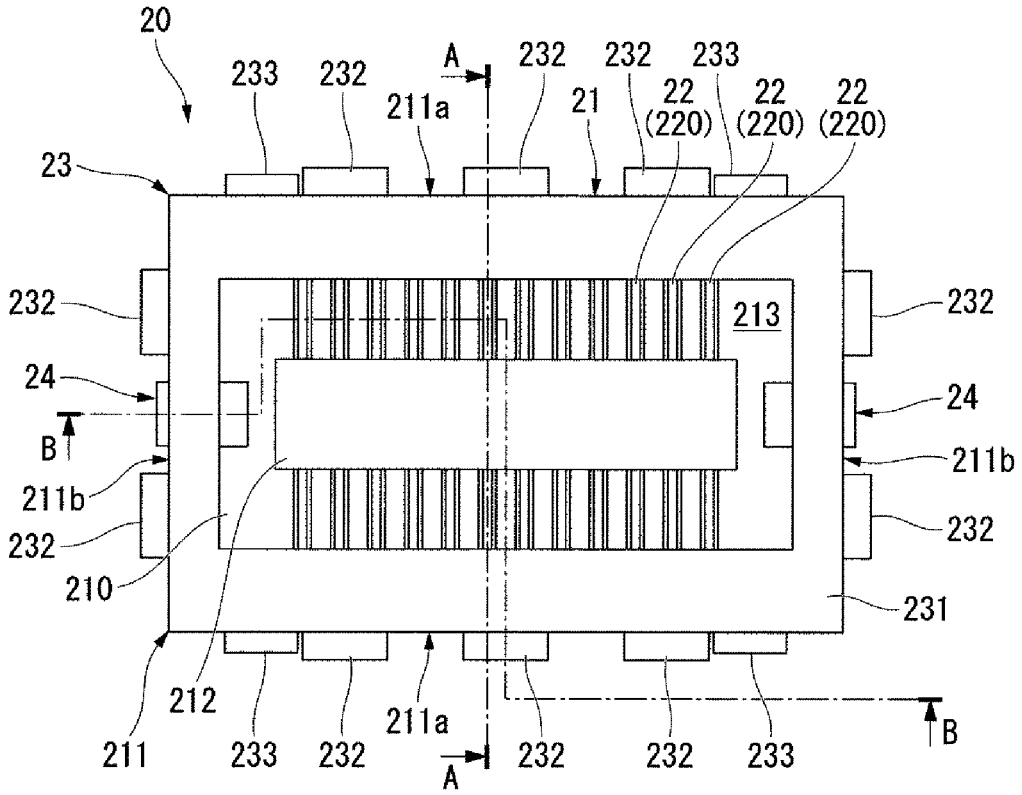
FIG. 4 shows a planar schematic diagram of a plug in the board-to-board connector according to the first embodiment of the present application.

Referring to FIGS. 1, 2, and 4, the plug 20 is a male connector configured to be insertable into the receptacle 10, and has the appearance of a substantially rectangular parallelepiped as a whole. The plug 20 comprises an electrical insulation plug housing 21, a plurality of signal contact elements 22, an electromagnetic interference shield 23, and power contact elements 24.

Referring to FIGS. 1 to 4, the receptacle housing 11 as well as the plug housing 21 are each a molded component made of one or more electrical insulation materials such as synthetic resin. The receptacle housing 11 and the plug housing 21 are formed so as to be engageable with each other, and in particular, shaped so that the plug housing 21 is insertable into the receptacle housing 11. Specifically, an outer rectangular loop-shaped recess no as well as an inner rectangular recess in which is located within the outer recess no are formed on the receptacle housing 11. On the other hand, the plug housing 21 comprises an outer peripheral portion 211 insertable into the outer recess no of the receptacle housing 11 and an inner peripheral portion 212 insertable into the inner recess in of the receptacle housing 11.

In more detail, referring to FIGS. 1 to 3, the receptacle housing 11 comprises a bottom portion 112, an outer peripheral portion 113, and an inner peripheral portion 114 which define the outer recess no and the inner recess 111. The bottom portion 112 is shaped into an approximate rectangle and is located adjacent and parallel to the first board 2. The outer peripheral portion 113 has an approximately rectangular-cylindrical shape and comprises four walls, that is, a pair of long side walls 113*a* opposite to each other and a pair of short side walls 113*b* opposite to each other. Each wall 113*a*, 113*b* projects from an outer periphery of the bottom portion 112 in a direction away from the first board 2. The inner peripheral portion 114 has an approximately rectangular-cylindrical shape smaller than the interior of the outer peripheral portion 113 and is small enough to be located inside the outer peripheral portion 113 with an approximately rectangular-cylindrically shaped space. That is, the outer peripheral portion 113 and the inner peripheral portion 114 define the outer rectangular loop-shaped recess no therebetween. The inner peripheral portion 114 comprises four walls, that is, a pair of long side walls 114*a* opposite to each other and a pair of short side walls 114*b* opposite to each other. Each wall 114*a*, 114*b* projects from a central site of the bottom portion 112 in a direction away from the first board 2. The space inside the inner peripheral portion 114 is the inner recess 111. The inner peripheral portion 114 is arranged in the same orientation as the outer peripheral portion 113 and shares a central point with the outer peripheral portion 113. The inner peripheral portion 114 has substantially the same height as the outer peripheral portion 113.

The bottom portion 112 of the receptacle housing 11 is provided with two openings 115 which are vertically formed therethrough. The openings 115 are shaped into an approximate rectangle and extend in the longitudinal direction of the board-to-board connector 1. The openings 115 are symmetrically arranged on both sides interposing the inner peripheral portion 114. That is, one of the openings 115 is located between one of the long side walls 113*a* of the outer peripheral portion 113 and one of the long side walls 114*a* of the inner peripheral portion 114, and the other of the openings 115 is located between the other of the long side walls 113*a* of the outer peripheral portion 113 and the other of the long side walls 114*a* of the inner peripheral portion 114.

Referring to FIGS. 1, 2, and 4, the plug housing 21 comprises a bottom portion 210 in addition to the outer peripheral portion 211 and the inner peripheral portion 212.

The bottom portion 210 is shaped into an approximate rectangle and is located adjacent and parallel to the second board 3. The outer peripheral portion 211 has an approximately rectangular-cylindrical shape and comprises four walls, that is, a pair of long side walls 211*a* opposite to each other and a pair of short side walls 211*b* opposite to each other. Each wall 211*a*, 211*b* projects from an outer periphery of the bottom portion 210 in a direction away from the second board 3. The inner peripheral portion 212 has an approximately rectangular parallelepiped shape smaller than the interior of the outer peripheral portion 211 and is small enough to be located inside the outer peripheral portion 211 with an approximately rectangular-cylindrical shaped space. That is, the outer peripheral portion 211 and the inner peripheral portion 212 define a rectangular loop-shaped recess 213 therebetween. The inner peripheral portion 212 is arranged in the same orientation as the outer peripheral portion 211 and shares a central point with the outer peripheral portion 211. The inner peripheral portion 212 has substantially the same height as the outer peripheral portion 211.

Referring to FIGS. 1 to 4, each of signal contact elements 12 and 22 is a narrow strip component made of one or more electro-conductive materials such as copper, copper alloy, or the like, and is formed by being bent into a desired shape. Each signal contact element 12 of the receptacle 10 is installed in the receptacle housing 11 in such a manner that a portion thereof is embedded in the receptacle housing 11. Each signal contact element 22 of the plug 20 is installed in the plug housing 21 in such a manner that a portion thereof is embedded in the plug housing 21. The plurality of signal contact elements 12 of the receptacle 10 are surrounded by the outer peripheral portion 113 of the receptacle housing 11, and the plurality of signal contact elements 22 of the plug 20 are surrounded by the outer peripheral portion 211 of the plug housing 21. The plurality of signal contact elements 12 of the receptacle 10 as well as the plurality of signal contact elements 22 of the plug 20 are arranged at equal intervals in the longitudinal direction of the board-to-board connector 1 and form two rows. The first and second rows of the signal contact elements 12 of the receptacle 10 are symmetrically arranged on both sides interposing the inner recess 111. The first and second rows of signal contact elements 22 of the plug 20 are symmetrically arranged on both sides interposing the inner peripheral portion 212. The plurality of signal contact elements 12 of the receptacle 10 and the plurality of signal contact elements 22 of the plug 20 are arranged and configured to be respectively electrically connected to each other when the plug 20 has been inserted into the receptacle 10 so as to enable signal transmission between signal transmitting lines on the first board 2 and signal transmitting lines on the second board 3. Specifically, the plurality of signal contact elements 12 and 22 are formed so that the plurality of signal contact elements 12 of the receptacle 10 are respectively engageable with the plurality of signal contact elements 22 of the plug 20, and in particular, are shaped so that each signal contact element 12 of the receptacle 10 is insertable into and contactable to the corresponding signal contact element 22 of the plug 20.

In more detail, referring to FIGS. 1 to 3, the signal contact element 12 of the receptacle 10 comprises a contact section 120, a soldering section 121, and an anchor section 122. The contact section 120 is exposed so as to be capable of contacting the signal contact elements 22 of the plug 20. The contact section 120 has a convex shape, and extends along an inner surface, a tip surface, and an outer surface of the long side wall 114*a* of the inner peripheral portion 114 of the receptacle housing 11. The anchor section 122 extends from an end of the contact section 120 to an end of the soldering section 121 and is embedded and fixed in the bottom portion 112. The soldering section 121 is exposed for soldering on the signal transmitting line on the first board 2 by SMT (surface mounted technology) or PIP (pin in paste technology). The soldering section 121 protrudes from the bottom portion 112 into the opening 115 in the bottom portion 112 so that the soldering section 121 is visible from the insertion port side of the receptacle 11. Due to such a soldering section 121, the entire length of the signal contact element 12 can be made shorter than a configuration wherein the soldering section of the signal contact elements of the receptacle protrudes from the outer peripheral portion of the receptacle housing, and thereby it is possible to reduce material cost for the signal contact elements 12 to lower than that of the above-mentioned configuration. In addition, since the soldering section 121 of the signal contact elements 12 can be shorter, a high co-planarity of the soldering sections 121 of the plurality of the signal contact elements 12 can be obtained so as to prevent defective soldering in the soldering section 121. Furthermore, since the soldering section 121 is visible from the insertion port side of the receptacle 11 through the opening 115, the co-planarity of the soldering sections 121 and the soldered portion in the soldering sections 121 can be easily inspected.

Referring to FIGS. 1, 2, and 4, the signal contact element 22 of the plug 20 comprises a contact section 220, a soldering section 221, and an anchor section 222. The contact section 220 is positioned within the recess 213 of the plug housing 21 and is exposed so as to be capable of contacting the signal contact elements 12 of the receptacle 10. The contact section 220 has a concave shape such that the contact section 120 of the signal contact element 12 of the receptacle 10 can be inserted therein. The contact section 220 is elastically deformable so that contact can be reliably maintained between the contact sections 120, 220. The soldering section 221 is exposed for soldering on the signal transmitting line on the second board 3 by SMT or PIP. The soldering section 221 protrudes from the outer peripheral portion 211. The anchor section 222 extends from an end of the contact section 220 to an end of the soldering section 221 and is embedded and fixed in the outer peripheral portion 211.

Referring to FIGS. 1 to 4, the shield 13 as well as the shield 23 are each a cover component capable of shielding EMI noise. These shields 13 and 23 are made of one or more electromagnetic wave shielding materials, for example, a metal plate material such as copper alloy, stainless steel, or the like, and are formed by pressing the metal plate material. Alternatively, the shields may be made of other materials such as metal mesh material, metal foam material, metal plating material, a metal-containing coating material, a metal-containing polymer material, electromagnetic shielding film material, or the like.

Referring to FIGS. 1 to 3, the shield 13 of the receptacle 10 is arranged and configured to continuously surround the plurality of signal contact elements 12 of the receptacle 10. Specifically, the shield 13 is attached to the outer peripheral portion 113 of the receptacle housing 11 such that the shield 13 covers the interior, a tip surface, and the exterior of the outer peripheral portion 113. The shield 13 comprises an interior section 130, tip sections 131, exterior sections 132, and an inner flange section 133. The interior section 130 has an approximately rectangular-cylindrical shape along the interior of the outer peripheral portion 113 of the receptacle housing 11 and is configured to cover the entire interior of the outer peripheral portion 113 of the receptacle housing 11. Each tip section 131 has a rectangular shape along the tip surface of the outer peripheral portion 113 of the receptacle housing 11 and is configured to cover the tip surface of the corresponding wall 113*a*, 113*b* of the outer peripheral portion 113. Each tip section 131 extends over the overall length of an inner surface of the corresponding wall 113*a*, 113*b*. Each tip section 131 is integrally provided in the interior section 130 and extends outward from a top end (an end on the insertion port side) of the interior section 130. The corners between the interior section 130 and the tip section 131 are chamfered in a flat planar form or a round form so as to facilitate the insertion of the plug 20 into the receptacle 10. Each exterior section 132 has a rectangular shape along the exterior of the outer peripheral portion 113 of the receptacle housing 11 and is configured to cover the outer surface of the corresponding wall 113*a*, 113*b* of the outer peripheral portion 113. Each exterior section 132 extends over the overall length of the tip section 131. Each exterior section 132 is integrally provided in the tip section 131 and is hung from the outer side end of the tip section 131. Each exterior section 132 is provided with at least one grounding portion 135 to be electrically connected to the first board 2. Each grounding portion 135 is a tab extending outward from a proximal end (an end on the side of the first board 2) of the exterior section 132. Each grounding portion 135 can be soldered on the first board 2 by SMT or PIP so as to allow electrical grounding of the shield 13. The inner flange section 133 has a rectangular loop shape along the outer periphery of the bottom portion 112 of the receptacle housing 11 and is configured to cover the outer periphery of the bottom portion 112. In addition, the shield 13 may be divided into a plurality of parts, and the shield 13 may be configured to discontinuously surround the plurality of the signal contact elements 12 of the receptacle 10.

Figure 5:
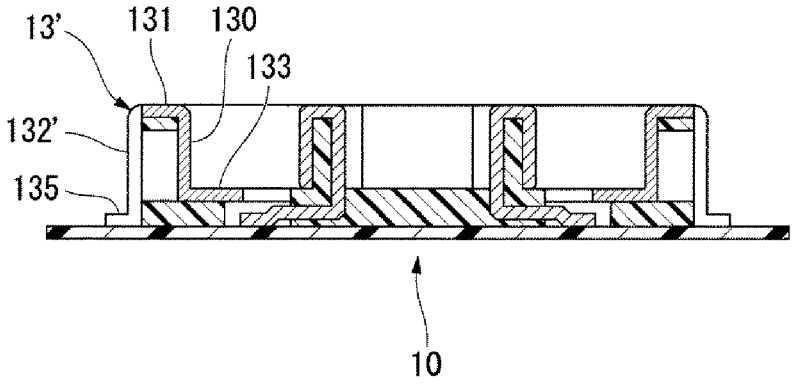
FIG. 5 shows a cross-sectional schematic diagram of a variation of a receptacle in the board-to-board connector according to the first embodiment of the present application.
Figure 6:
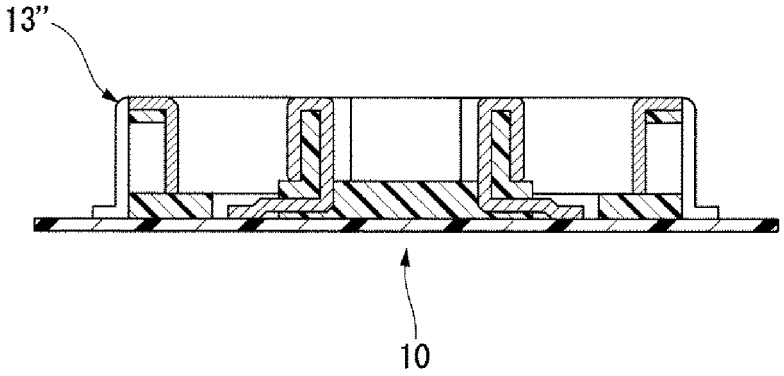
FIG. 6 shows a cross-sectional schematic diagram of another variation of a receptacle in the board-to-board connector according to the first embodiment of the present application.

The exterior section 132 does not necessarily need to extend over the overall length of the tip section 131 and to cover most of the exterior of the outer peripheral portion 113 of the receptacle housing 11. For example, as shown in FIG. 5, the width of the exterior sections 132' of the shield 13' of the receptacle 10 may be similar to the width of the grounding portion 135 so as to merely connect the tip section 131 to the grounding portion 135. Also, the shield 13 of the receptacle 10 does not necessarily need to include the inner flange section 133. For example, as shown in FIG. 6, there may be no inner flange section in the shield 13" of the receptacle 10.

Referring to FIGS. 1, 2, and 4, the shield 23 of the plug 20 is arranged and configured to continuously surround the plurality of signal contact elements 22 of the plug 20. Specifically, the shield 23 is attached to the outer peripheral portion 211 of the plug housing 21 such that the shield 23 covers the tip surface and exterior of the outer peripheral portion 211. The shield 23 comprises an exterior section 230 and a tip section 231. The exterior section 230 has an approximately rectangular-cylindrical shape along the exterior of the outer peripheral portion 211 of the plug housing 21 and is configured to cover substantially the entire exterior of the outer peripheral portion 211 of the plug housing 21. The exterior section 230 is provided with cutouts 230*a* through which the soldering section 221 of the signal contact elements 22 is exposed. The cutouts 230*a* are formed on both long-side walls of the exterior section 230. The tip section 231 has a rectangular loop shape along the tip surface of the outer peripheral portion 211 of the plug housing 21 and is configured to cover the entire tip surface of the outer peripheral portion 211. The tip section 231 is integrally provided in the exterior section 230 and extends inward from a tip end of the exterior section 230. The corners between the exterior section 230 and the tip section 231 are chamfered in a flat planar form or a round form so as to facilitate the insertion of the plug 20 into the receptacle 10. The exterior section 230 is provided with at least one grounding portion 233 to be electrically connected to the second board 3. Each grounding portion 233 is a tab extending outward from a proximal end (an end on the side of the second board 3) of the exterior section 230. Each grounding portion 233 can be soldered on the second board 3 by SMT or PIP so as to allow electrical grounding of the shield 23. In addition, the shield 23 may be divided into a plurality of parts, the shield 23 may be configured to discontinuously surround the plurality of the signal contact elements 22 of the plug 20.

Referring to FIGS. 1 to 4, the shield 13 of the receptacle 10 and the shield 23 of the plug 20 are configured to be in direct contact with each other when the plug 20 has been inserted into the receptacle 10 in order to prevent EMI noise generated by the signal contact elements 12, 22 from leaking out. In particular, in order to eliminate a path through which EMI noise may pass, the contact arrangement of the shields 13 and 23 is provided in the entire perimeter of the connector 1. The contact arrangement does not necessarily need to be continuous in the entire perimeter of the connector 1, and may be discontinuous so that EMI noise is substantially shielded completely.

Specifically, as shown in FIGS. 1, 2, and 4, the exterior section 230 of the shield 23 of the plug 20 is provided with a plurality of abutment portions 232 for bringing the shield 23 of the plug 20 into direct contact with the shield 13 of the receptacle 10. Each abutment portion 232 is formed like a leaf spring having a rectangular shape. Each abutment portion 232 outwardly projects from an outer surface of the shield 23 of the plug 20 in an oblique direction so as to abut the interior section 130 of the shield 13 of the receptacle 10 when the plug 20 has been inserted into the receptacle 10. The abutment portion 232 is configured to be elastically deformed by abutment with the interior section 130 of the shield 13 of the receptacle 10 when the plug 20 has been inserted into the receptacle 10. Such abutment portion 232 is formed by cutting the metal plate material of the shield 13 into a channel shape and folding outward a portion surrounded by the cutting line. The folding line of the abutment portion 232 is provided on the side closer to the tip section 231 and the abutment portion 232 is opened on the side closer to the second board 3. The plurality of abutment portions 232 are positioned at intervals around the entire exterior section 230 of the shield 23 of the plug 20. The interval between the plurality of abutment portions 232 can be decided according to the frequency band of the EMI noise to be shielded by the shields 13 and 23.

Referring to FIGS. 2 to 4, the power contact elements 14 of the receptacle 10 and the power contact elements 24 of the plug 20 are current-transmitting elements for enabling high-current transmission between the first board 2 and the second board 3. These power contact elements 14 and 24 are each a wide strip component made of one or more electro-conductive materials such as copper, copper alloy, or the like, and are formed by being bent into a desired shape. The strip material of the power contact elements 14 and 24 is wider than that of the signal contact elements 12 and 22 so that a high current such as 5.0 A or more can flow through the power contact elements 14 and 24 which have been electrically connected to each other. Each power contact element 14 of the receptacle 10 is installed in the receptacle housing 11 in such a manner that a portion thereof is embedded in the receptacle housing 11. Each power contact element 24 of the plug 20 is installed in the plug housing 21 in such a manner that a portion thereof is embedded in the plug housing 21. The power contact element 14 of the receptacle 10 and the power contact element 24 of the plug 20 are arranged and configured to be respectively electrically connected to each other when the plug 20 has been inserted into the receptacle 10.

In more detail, referring to FIGS. 2 and 3, the power contact element 14 of the receptacle 10 comprises a contact section 140 and an anchor section 141. The contact section 140 is exposed so as to be capable of contacting the power contact element 24 of the plug 20. The contact section 140 has a convex shape, and extends along an inner surface, a tip surface, and an outer surface of the short side wall 114*b* of the inner peripheral portion 114 of the receptacle housing 11. The anchor section 141 is embedded and fixed in the bottom portion 112. The power contact element 14 of the receptacle 10 can be soldered on the current transmitting line on the first board 2 by SMT or PIP.

Referring to FIGS. 2 and 4, the power contact element 24 of the plug 20 comprises a contact section 240, a soldering section 241, and an anchor section 242. The contact section 240 is positioned within the recess 213 of the plug housing 21 and is exposed so as to be capable of contacting the contact section 140 of the power contact element 14 of the receptacle 10. The contact section 240 is elastically deformable so that contact can be reliably maintained between the contact sections 140, 240. The soldering section 241 is exposed for soldering on the current transmitting line on the second board 3 by SMT or PIP. The soldering section 241 protrudes from the outer peripheral portion 211. The anchor section 242 extends from an end of the contact section 240 to an end of the soldering section 241 and is embedded and fixed in the outer peripheral portion 211.

Second Embodiment

Figure 7:
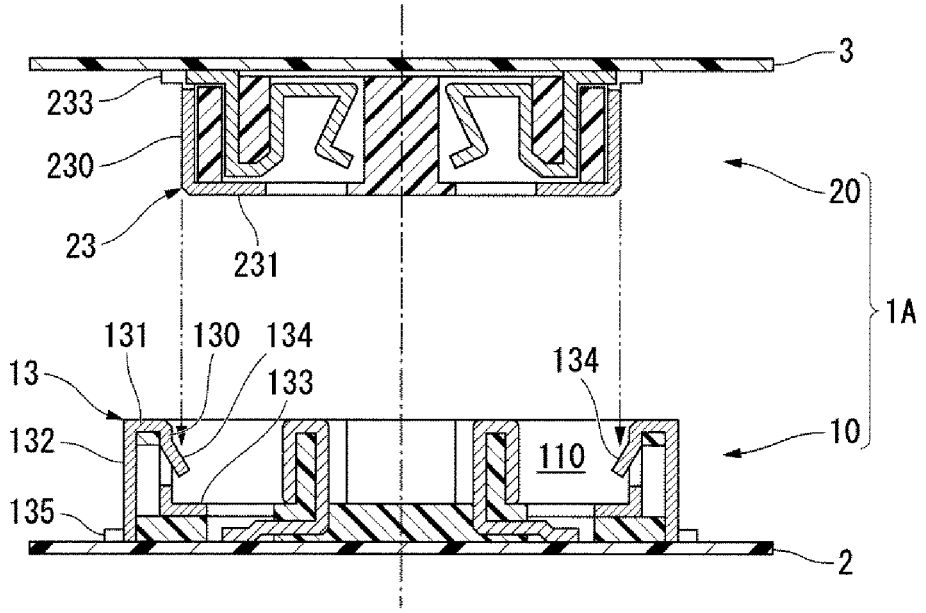
FIG. 7 shows a cross-sectional schematic diagram of a board-to-board connector according to a second embodiment of the present application.

FIG. 7 shows the board-to-board connector 1A according to the second embodiment of the present application. The board-to-board connector 1A has common characteristics with the board-to-board connector 1 of the above-described first embodiment, and a detailed description of these common characteristics is omitted. The following is a detailed description of different characteristics of the board-to-board connector 1A as compared to the board-to-board connector 1 of the first embodiment.

As shown in FIG. 7, the interior section 130 of the shield 13 of the receptacle 10 is provided with a plurality of abutment portions 134 for bringing the shield 13 of the receptacle 10 into direct contact with the shield 23 of the plug 20. Each abutment portion 134 is formed like a leaf spring having a rectangular shape. Each abutment portion 134 inwardly (toward the inside of the outer recess no of the receptacle housing 11) projects from an inner surface of the shield 13 of the receptacle 10 in an oblique direction so as to abut the exterior section 230 of the shield 23 of the plug 20 when the plug 20 has been inserted into the receptacle 10. The abutment portion 134 is configured to be elastically deformed by abutment with the exterior section 230 of the shield 23 of the plug 20 when the plug 20 has been inserted into the receptacle 10. Such abutment portion 134 is formed by cutting the metal plate material of the shield 23 into a channel shape and folding inward a portion surrounded by the cutting line. The folding line of the abutment portion 134 is provided on the side closer to the tip section 131 and the abutment portion 134 is opened on the side closer to the first board 2. The plurality of abutment portions 134 are positioned at intervals around the entire interior section 130 of the shield 13 of the receptacle 10. The interval between the plurality of abutment portions 134 can be decided according to the frequency band of the EMI noise to be shielded by the shields 13 and 23.

In contrast to the board-to-board connector 1 according to the first embodiment of the present application, an abutment portion like a leaf spring is not provided on the exterior section 230 of the shield 23 of the plug 20 in the board-to-board connector 1A according to the second embodiment.

Third Embodiment

Figure 8:
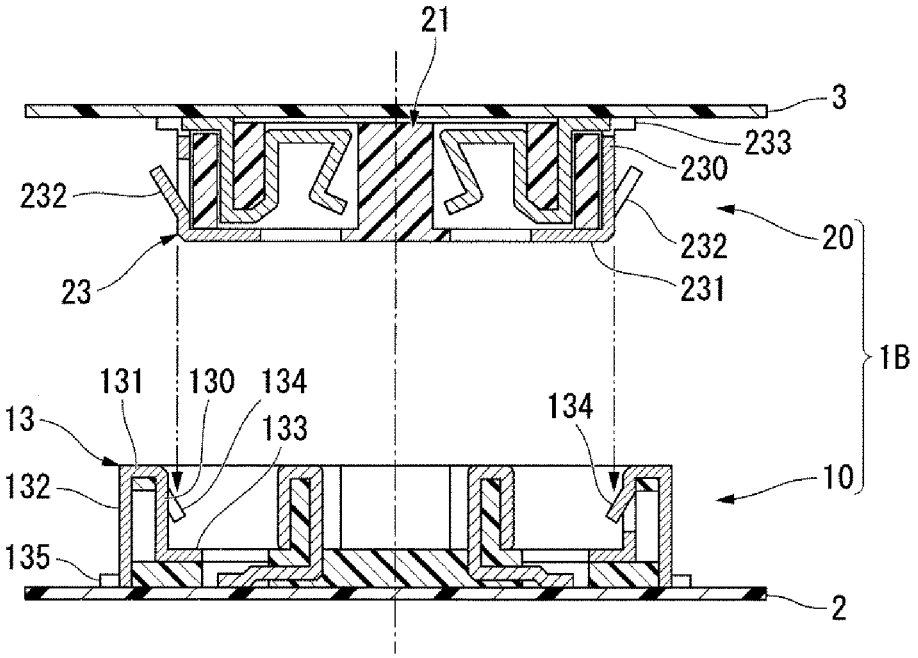
FIG. 8 shows a cross-sectional schematic diagram of a board-to-board connector according to a third embodiment of the present application, and this is a cross-sectional view along line C-C shown in FIGS. 9 and 10.
Figure 9:
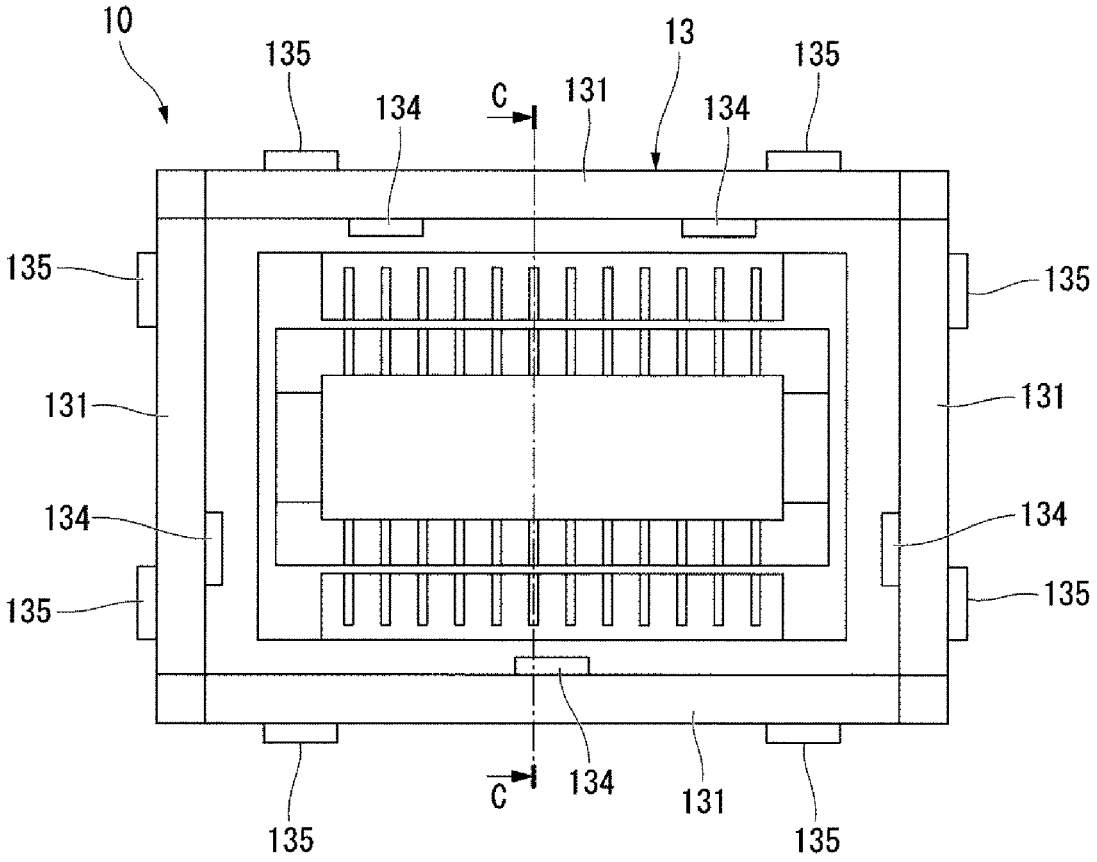
FIG. 9 shows a planar schematic diagram of a receptacle in the board-to-board connector according to the third embodiment of the present application.
Figure 10:
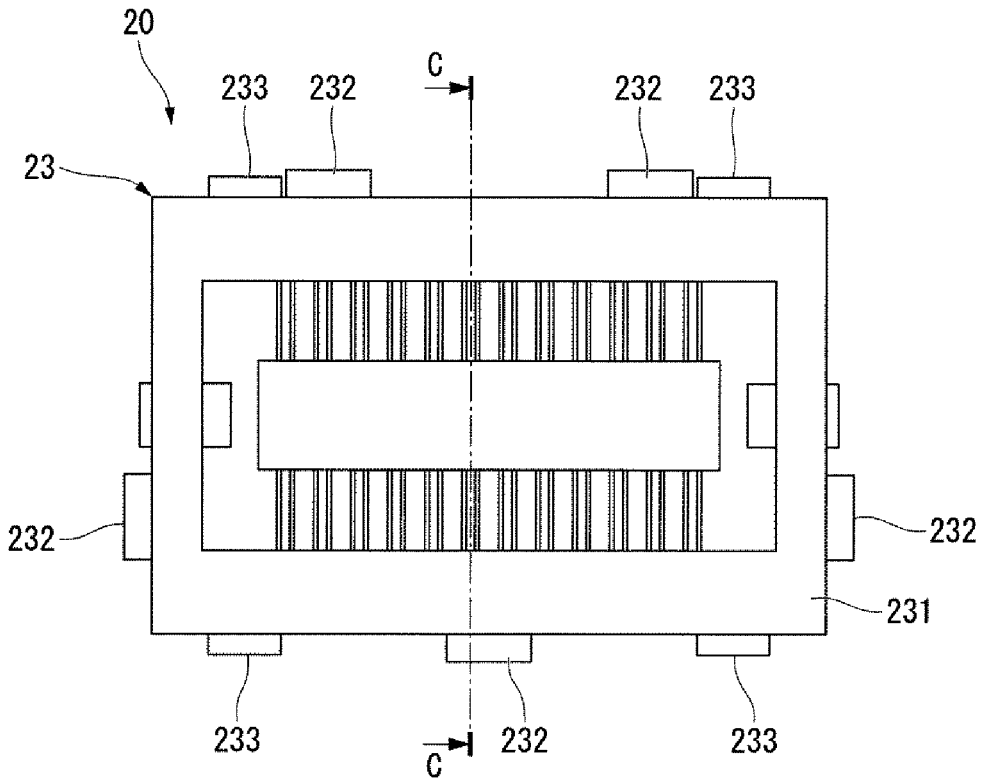
FIG. 10 shows a planar schematic diagram of a plug in the board-to-board connector according to the third embodiment of the present application.

FIGS. 8 to 10 show the board-to-board connector 1B according to the third embodiment of the present application. The board-to-board connector 1B has common characteristics with the board-to-board connectors 1 and 1A of the above-described first and second embodiments, and a detailed description of these common characteristics is omitted. The following is a detailed description of different characteristics of the board-to-board connector 1B as compared to the board-to-board connectors 1 and 1A of the first and second embodiments.

As shown in FIG. 8, both the exterior section 230 of the shield 23 of the plug 20 and the interior section 130 of the shield 13 of the receptacle 10 are provided with a plurality of abutment portions 232 and 134 for bringing the shield 23 of the plug 20 and the shield 13 of the receptacle 10 into mutual direct contact with each other.

Specifically, as shown in FIGS. 8 and 9, each of the first abutment portions 232 provided on the exterior section 230 of the shield 23 of the plug 20 is formed like a leaf spring having a rectangular shape. Each first abutment portion 232 outwardly projects from an outer surface of the shield 23 of the plug 20 in an oblique direction so as to abut the interior section 130 of the shield 13 of the receptacle 10 when the plug 20 has been inserted into the receptacle 10. The first abutment portion 232 is configured to be elastically deformed by abutment with the interior section 130 of the shield 13 of the receptacle 10 when the plug 20 has been inserted into the receptacle 10. Such first abutment portion 232 is formed by cutting the metal plate material of the shield 13 into a channel shape and folding outward a portion surrounded by the cutting line. The folding line of the first abutment portion 232 is provided on the side closer to the tip section 231 and the first abutment portion 232 is opened on the side closer to the second board 3.

As shown in FIGS. 8 and 10, each of the second abutment portions 134 provided on the interior section 130 of the shield 13 of the receptacle 10 is formed like a leaf spring having a rectangular shape. Each second abutment portion 134 inwardly (toward the inside of the outer recess no of the receptacle housing 11) projects from an inner surface of the shield 13 of the receptacle 10 in an oblique direction so as to abut the exterior section 230 of the shield 23 of the plug 20 when the plug 20 has been inserted into the receptacle 10. The second abutment portion 134 is configured to be elastically deformed by abutment with the exterior section 230 of the shield 23 of the plug 20 when the plug 20 has been inserted into the receptacle 10. Such second abutment portion 134 is formed by cutting the metal plate material of the shield 23 into a channel shape and folding inward a portion surrounded by the cutting line. The folding line of the second abutment portion 134 is provided on the side closer to the tip section 131 and the second abutment portion 134 is opened on the side closer to the first board 2.

Referring to FIGS. 8 to 10, the first and second abutment portions 232 and 134 are positioned at intervals around the entire exterior section 230 of the shield 23 of the plug 20 and around the entire interior section 130 of the shield 13 of the receptacle 10. In particular, the plurality of first abutment portions 232 and the plurality of second abutment portions 134 are positioned so that the first abutment portions 232 can be arranged alternately with the second abutment portions 134 in a peripheral direction of the exterior section 230 of the shield 23 and the interior section 130 of the shield 13 when the plug 20 has been inserted into the receptacle 10. That is, the board-to-board connector 13 exhibits a relative positional relationship between the first abutment portions 232 and the second abutment portions 134 such that they can be displaced from each other in the peripheral direction and be away from each other without overlapping when the plug 20 has been inserted into the receptacle 10. The interval between the adjacent first and second abutment portions 232 and 134 can be decided according to the frequency band of the EMI noise to be shielded by the shields 13 and 23.

Fourth Embodiment

Figure 11:
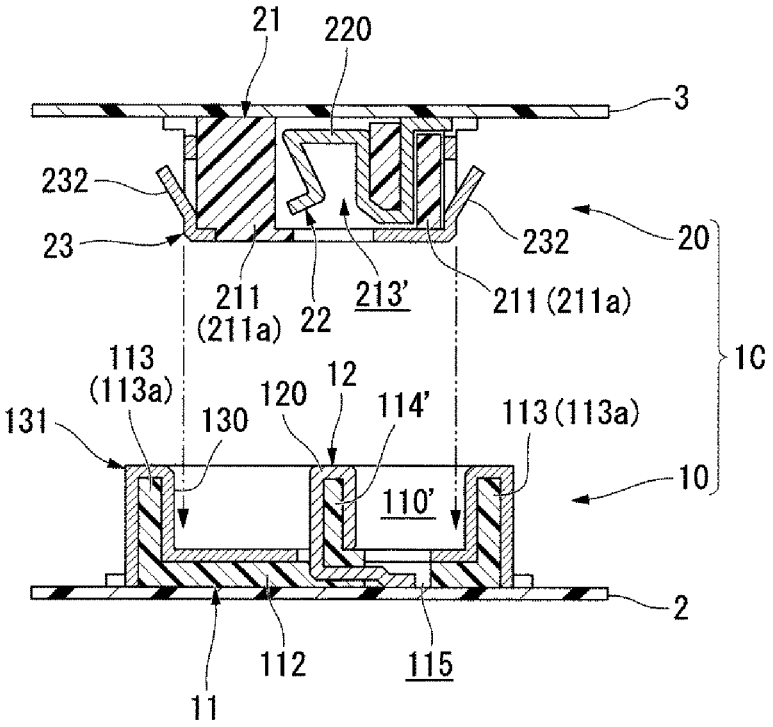
FIG. 11 shows a cross-sectional schematic diagram of a single-row-type board-to-board connector according to a fourth embodiment of the present application.

FIG. 11 shows a single-row type board-to-board connector 1C according to the fourth embodiment of the present application. The board-to-board connector 1C has common characteristics with the board-to-board connector 1 of the above-described first embodiment, and a detailed description of these common characteristics will be omitted. The following is a detailed description of different characteristics of the board-to-board connector 1C as compared to the board-to-board connector 1 of the first embodiment.

As shown in FIG. 11, a rectangular loop-shaped recess 110' is formed on the receptacle housing 11 instead of the outer rectangular-loop shaped recess no and the inner rectangular shaped recess 111 shown in FIGS. 1 to 3. On the other hand, the plug housing 21 comprises a peripheral portion 211' insertable into the recess 110' of the receptacle housing 11.

In more detail, the receptacle housing 11 comprises the bottom portion 112, the outer peripheral portion 113, and an inner wall portion 114' which define the recess 110'. The inner wall portion 114' has an approximately rectangular shape and is located inside the outer peripheral portion 113 with an approximately rectangular-cylindrically shaped space. That is, the outer peripheral portion 113 and the inner wall portion 114' define the rectangular loop-shaped recess 110' therebetween. The inner wall portion 114' projects from a central site of the bottom portion 112 in a direction away from the first board 2. The inner wall portion 114' is arranged in the same orientation as the outer peripheral portion 113. The inner wall portion 114' has substantially the same height as the outer peripheral portion 113. The bottom portion 112 of the receptacle housing 11 is provided with one opening 115 which is vertically formed therethrough. The opening 115 is located between one of the long side walls 113*a* of the outer peripheral portion 113 and the inner wall portion 114'. The plurality of signal contact elements 12 of the receptacle 10 are installed in the inner wall portion 114' of the receptacle housing 11. The plurality of signal contact elements 12 of the receptacle 10 are arranged at equal intervals in the longitudinal direction of the board-to-board connector 1C and form a single row. The contact section 120 of the signal contact elements 12 extends along one of the opposed side surfaces, a tip surface, and the other of the opposed side surfaces of the inner wall portion 114' of the receptacle housing 11.

The opposed long side walls 211*a* and the opposed short side walls 211*b* of the peripheral portion 211' define a rectangular-shaped recess 213' therebetween. The plurality of signal contact elements 22 of the plug 20 are installed in one of the opposed long side walls 211*a* of the peripheral portion 211'. The plurality of signal contact elements 22 of the plug 20 are arranged at equal intervals in the longitudinal direction of the board-to-board connector 1C and form a single row. The contact section 220 of the signal contact elements 22 is positioned within the recess 213' of the plug housing 21.

Due to the board-to-board connector 1, 1A, 1B, or 1C, the shielding performance in the connector 1, 1A, 1B, or 1C can be improved. As the result, a leakage of EMI noise generated by the signal contact elements 12 and 22 of the receptacle 10 and the plug 11 can be eliminated or reduced, and interference between the EMI noise and an RF signal in the electronic device such as a smartphone can be eliminated or reduced. Accordingly, a device in which the connector 1, 1A, 1B, or 1C is mounted can improve antenna performance and can be adaptable to high speed signal transmission.

The number of rows of the plurality of signal contact elements of the receptacle and the plug can be appropriately changed, and the plurality of signal contact elements may form three rows or more. In addition, the shield of the receptacle and the shield of the plug may be in direct contact with each other continuously in the entire perimeter of the connector.

Although preferred embodiments of the present invention have been disclosed for illustrative purposes, those skilled in the art will appreciate that various modifications, additions, and substitutions are possible, without departing from the scope and spirit of the invention as disclosed in the accompanying claims.

The invention claimed is:

1. A board-to-board connector, comprising:

a first connector comprising a plurality of first signal contacts; and a second connector comprising a plurality of second signal contacts;

wherein the first connector further comprises a first shield which discontinuously surrounds the plurality of first signal contacts of the first connector, and the second connector further comprises a second shield which discontinuously surrounds the plurality of second signal contacts of the second connector, and wherein the second connector and the first connector are configured in a manner that, when the second connector is positioned in the first connector, the first shield and the second shield are in direct contact with each other through abutments to continuously surround the plurality of first signal contacts of the first connector and the plurality of second signal contacts of the second connector; and wherein the second connector and the first connector are further configured in a manner that, when the second connector is positioned in the first connector, each second signal contact of the plurality of second signal contacts of the second connector is in contact with a corresponding first signal contact of the plurality of first signal contacts of the first connector, a sidewall of the first shield of the first connector and a sidewall of the second shield of the second connector are positioned next to each other, the sidewall of the first shield of the first connector faces and is parallel to the sidewall of the second shield of the second connector, and the abutments of the second shield of the second connector are directly contactable with the first shield of the first connector.

2. The board-to-board connector according to claim 1, wherein the first shield comprises two long sides and two short sides, and each side of the two long sides and the two short sides comprises at least one respective grounding portion.

3. The board-to-board connector according to claim 1, wherein:

the first connector further comprises a first power contact, and strip material of the first power contact is wider than that of a first signal contact of the plurality of first signal contacts;

the second connector further comprises a second power contact, and strip material of the second power contact is wider than that of a second signal contact of the plurality of second signal contacts; and the first power contact of the first connector and the second power contact of the second connector are configured to transmit current and be electrically connected to each other when the second connector is positioned in the first connector.

4. The board-to-board connector according to claim 1, wherein the second shield of the second connector comprises a plurality of abutments configured to bring the second shield of the second connector into direct contact with the first shield of the first connector, and abutments of the plurality of abutments are positioned at intervals.

5. The board-to-board connector according to claim 4, wherein each of the plurality of abutments is configured to be elastically deformed by abutment with the first shield of the first connector when the second connector is positioned in the first connector.

6. The board-to-board connector according to claim 4, wherein each of the plurality of abutments extends from a respective surface of the second shield of the second connector, and each of the plurality of abutments comprises a metal material in a channel shape.

7. The board-to-board connector according to claim 1, wherein:

the first connector further comprises an first connector housing, the plurality of first signal contacts of the first connector part is installed in the first connector housing, and the first connector housing comprises a first bottom portion, an first outer peripheral portion, and an first inner peripheral portion;

the first bottom portion, the first outer peripheral portion, and the first inner peripheral portion of the first connector define an outer recess and an inner recess, and the outer recess is a rectangular loop-shaped recess;

the plurality of first signal contacts comprises two rows of signal contacts, and the two rows of signal contacts of the plurality of first signal contacts are symmetrically arranged on two opposite sides of the inner recess;

the second connector comprises a second connector housing, the plurality of second signal contacts of the second connector are installed in the second connector housing, and the second connector housing comprises a second outer peripheral portion that is configured to be insertable into the outer recess of the first connector housing, and a second inner peripheral portion that is configured to be insertable into the inner recess of the first connector housing, and a second bottom portion; and the plurality of second signal contacts comprises two rows of signal contacts, and the two rows of signal contacts of the plurality of second signal contacts are symmetrically arranged on two opposite sides of the second inner peripheral portion.

8. The board-to-board connector according to claim 7, wherein each second signal contact of the plurality of second signal contacts of the second connector further comprises a respective second soldering section, and the second shield comprises cutouts through which the respective second soldering sections of the plurality of second signal contacts are exposed.

9. The board-to-board connector according to claim 7, wherein:

the first bottom portion of the first connector housing comprises two openings, and the two openings are symmetrically arranged on two opposite sides of the first inner peripheral portion; and each first signal contact of the plurality of first signal contacts comprises a respective first soldering section, and the respective first soldering section of each first signal contact protrudes into at least one of the two openings in a manner that the respective first soldering section is visible from an insertion port side of the first connector.

10. The board-to-board connector according to claim 9, wherein:

the plurality of first signal contacts of the first connector further comprises a first contact section, the first contact section has a convex shape, and the first contact section extends along an inner surface, a tip surface, and an outer surface of the first inner peripheral portion; and the plurality of second signal contacts of the second connector comprises a second contact section, and the second contact section has a concave shape configured in a manner that the first contact section of the plurality of first signal contacts of the first connector is insertable into the second contact section.

11. A electronic device, comprising a board-to-board connector, the board-to-board connector comprising:

a first connector comprising a plurality of first signal contacts; and a second connector comprising a plurality of second signal contacts;

wherein the first connector further comprises a first shield which discontinuously surrounds the plurality of first signal contacts of the first connector, and the second connector further comprises a second shield which discontinuously surrounds the plurality of second signal contacts of the second connector, and wherein the second connector and the first connector are configured in a manner that, when the second connector is positioned in the first connector, the first shield and the second shield are in direct contact with each other through an abutment to continuously surround the plurality of first signal contacts of the first connector and the plurality of second signal contacts of the second connector; and wherein the second connector and the first connector are further configured in a manner that, when the second connector is positioned in the first connector, each second signal contact of the plurality of second signal contacts of the second connector is in contact with a corresponding first signal contact of the plurality of first signal contacts of the first connector, a sidewall of the first shield of the first connector and a sidewall of the second shield of the second connector are positioned next to each other, and the sidewall of the first shield of the first connector faces and is parallel to the sidewall of the second shield of the second connector, and the abutments of the second shield of the second connector is directly contactable with the first shield of the first connector.

12. The electronic device according to claim 11, wherein the first shield comprises two long sides and two short sides, and each side of the two long sides and two short sides comprises at least one respective grounding portion.

13. The electronic device according to claim 11, wherein:

the first connector further comprises a first power contact, and strip material of the first power contact is wider than that of a first signal contact of the plurality of first signal contacts;

the second connector further comprises a second power contact, and strip material of the second power contact is wider than that of a second signal contact of the plurality of second signal contacts; and the first power contact of the first connector and the second power contact of the second connector are configured to transmit current and be electrically connected to each other when the second connector is positioned in the first connector.

14. The electronic device according to claim 11, wherein the second shield of the second connector comprises a plurality of abutments configured to bring the second shield of the second connector into direct contact with the first shield of the first connector, and abutment of the plurality of abutments are positioned at intervals.

15. The electronic device according to claim 14, wherein each of the plurality of abutment is configured to be elastically deformed by abutment with the first shield of the first connector when the second connector is positioned in the first connector.

16. The electronic device according to claim 14, wherein each of the plurality of abutments extends from a respective surface of the second shield of the second connector, and each of the plurality of abutments comprises a metal material in a channel shape.

17. The electronic device according to claim 11, wherein:

the first connector further comprises an first connector housing, the plurality of first signal contacts of the first connector are installed in the first connector housing, and the first connector housing comprises a first bottom portion, an first outer peripheral portion, and an first inner peripheral portion;

the first bottom portion, the first outer peripheral portion, and the first inner peripheral portion of the first connector define an outer recess and an inner recess, and the outer recess is a rectangular loop-shaped recess;

the plurality of first signal contacts comprises two rows of signal contacts, and the two rows of signal contacts of the plurality of first signal contacts are symmetrically arranged on two opposite sides of the inner recess; and the second connector comprises a second connector housing, the plurality of second signal contacts of the second connector are installed in the second connector housing, and the second connector housing comprises a second outer peripheral portion that is configured to be insertable into the outer recess of the first connector housing, and a second inner peripheral portion that is configured to be insertable into the inner recess of the first connector housing and a second bottom portion; and the plurality of second signal contacts comprises two rows of signal contacts, and the two rows of signal contacts of the plurality of second signal contacts are symmetrically arranged on two opposite sides of the second inner peripheral portion.

18. The electronic device according to claim 17, wherein each second signal contact of the plurality of second signal contacts of the second connector further comprises a respective second soldering section, and the second shield comprises cutouts through which the respective second soldering sections of the plurality of second signal contacts are exposed.

19. The electronic device according to claim 17, wherein:

the first bottom portion of the first connector housing comprises two openings, and the two openings are symmetrically arranged on two opposite sides of the first inner peripheral portion; and each first signal contact of the plurality of first signal contacts comprises a respective first soldering section, and the respective first soldering section of each first signal contact element protrudes into at least one of the two openings in a manner that the respective soldering section is visible from an insertion port side of the first connector.

20. The electronic device according to claim 19, wherein:

the plurality of first signal contacts of the first connector further comprises a first contact section, the first contact section has a convex shape, and the first contact section extends along an inner surface, a tip surface, and an outer surface of the first inner peripheral portion; and the plurality of second signal contacts of the second connector comprises a second contact section, the second contact section has a concave shape configured in a manner that the first contact section of the plurality of first signal contacts of the first connector are insertable into the second contact section.

* * * * *